US006048448A

United States Patent [19]

Nirell

[11] Patent Number: 6,048,448

[45] Date of Patent: Apr. 11, 2000

[54] DELAYED COKING PROCESS AND METHOD OF FORMULATING DELAYED COKING FEED CHARGE

[75] Inventor: Kai G. Nirell, Houston, Tex.

[73] Assignee: The Coastal Corporation, Houston, Tex.

[21] Appl. No.: 08/886,594

[22] Filed: Jul. 1, 1997

[51] Int. Cl.[7] ..... C10G 51/04; C10G 9/14

[52] U.S. Cl. ..... 208/67; 208/50; 208/131; 208/40; 208/76

[58] Field of Search ..... 208/131, 50, 67, 208/48 R, 40, 76

[56] References Cited

U.S. PATENT DOCUMENTS

| | | | |
|---|---|---|---|
| 2,687,986 | 8/1954 | Jennings et al. | 208/76 |
| 2,752,290 | 6/1956 | Beattie | 208/40 |
| 2,768,119 | 10/1956 | Nash | 208/40 |
| 2,922,755 | 1/1960 | Hackley, Jr. | 208/131 |
| 3,116,231 | 12/1963 | Adee | 208/46 |
| 3,412,009 | 11/1968 | Smith et al. | 208/72 |
| 3,563,884 | 2/1971 | Bloomer et al. | 208/81 |
| 3,617,514 | 11/1971 | Marlar | 208/131 |
| 3,684,697 | 8/1972 | Gamson | 208/131 |
| 3,759,822 | 9/1973 | Folkins | 208/131 |
| 3,817,853 | 6/1974 | Folkins | 208/50 |
| 3,907,664 | 9/1975 | Janssen et al. | 208/80 |
| 3,960,704 | 6/1976 | Kegler et al. | 208/50 |
| 4,028,227 | 6/1977 | Gustafson | 208/216 PP |
| 4,032,435 | 6/1977 | Schmitt, Jr. et al. | 208/216 PP |
| 4,043,898 | 8/1977 | Kegler | 208/50 |
| 4,176,046 | 11/1979 | McMonaghy, Jr. | 208/50 |
| 4,178,229 | 12/1979 | McConaghy et al. | 208/50 |
| 4,325,810 | 4/1982 | Alford et al. | 208/112 |
| 4,358,366 | 11/1982 | Alford et al. | 208/112 |
| 4,427,532 | 1/1984 | Varghese | 208/50 |
| 4,443,325 | 4/1984 | Chen et al. | 208/55 |
| 4,492,625 | 1/1985 | Allan | 208/131 |
| 4,518,487 | 5/1985 | Graf et al. | 208/131 |
| 4,547,284 | 10/1985 | Sze et al. | 208/50 |
| 4,604,186 | 8/1986 | Lutz et al. | 208/50 |
| 4,642,175 | 2/1987 | Rudnick | 208/88 |
| 4,686,027 | 8/1987 | Bonilla et al. | 208/39 |
| 4,832,823 | 5/1989 | Goyal et al. | 208/131 |
| 4,983,272 | 1/1991 | Stavropoulos | 208/50 |
| 5,028,311 | 7/1991 | Shigley et al. | 208/131 |
| 5,092,982 | 3/1992 | Becraft | 208/131 |
| 5,350,503 | 9/1994 | Freymeyer et al. | 208/131 |
| 5,356,530 | 10/1994 | Calderon | 208/108 |
| 5,645,712 | 7/1997 | Roth | 208/131 |

*Primary Examiner*—Walter D. Griffin
*Attorney, Agent, or Firm*—Browning Bushman

[57] ABSTRACT

A process for upgrading petroleum residua to more valuable products by visbreaking or otherwise thermally cracking a petroleum residuum to produce a thermally cracked bottoms stream, vacuum distilling at least a portion of the thermally cracked bottoms stream to produce a vacuum distilled thermally cracked pitch, blending a portion of the pitch with a hydrocarbon residuum that is not a vacuum distilled thermally cracked pitch to produce a delayed coker feed component, producing a delayed coker heater charge having a recycle ratio, by weight, of less than about 1.27:1, and introducing the coker heater charge into a delayed coker.

10 Claims, 1 Drawing Sheet

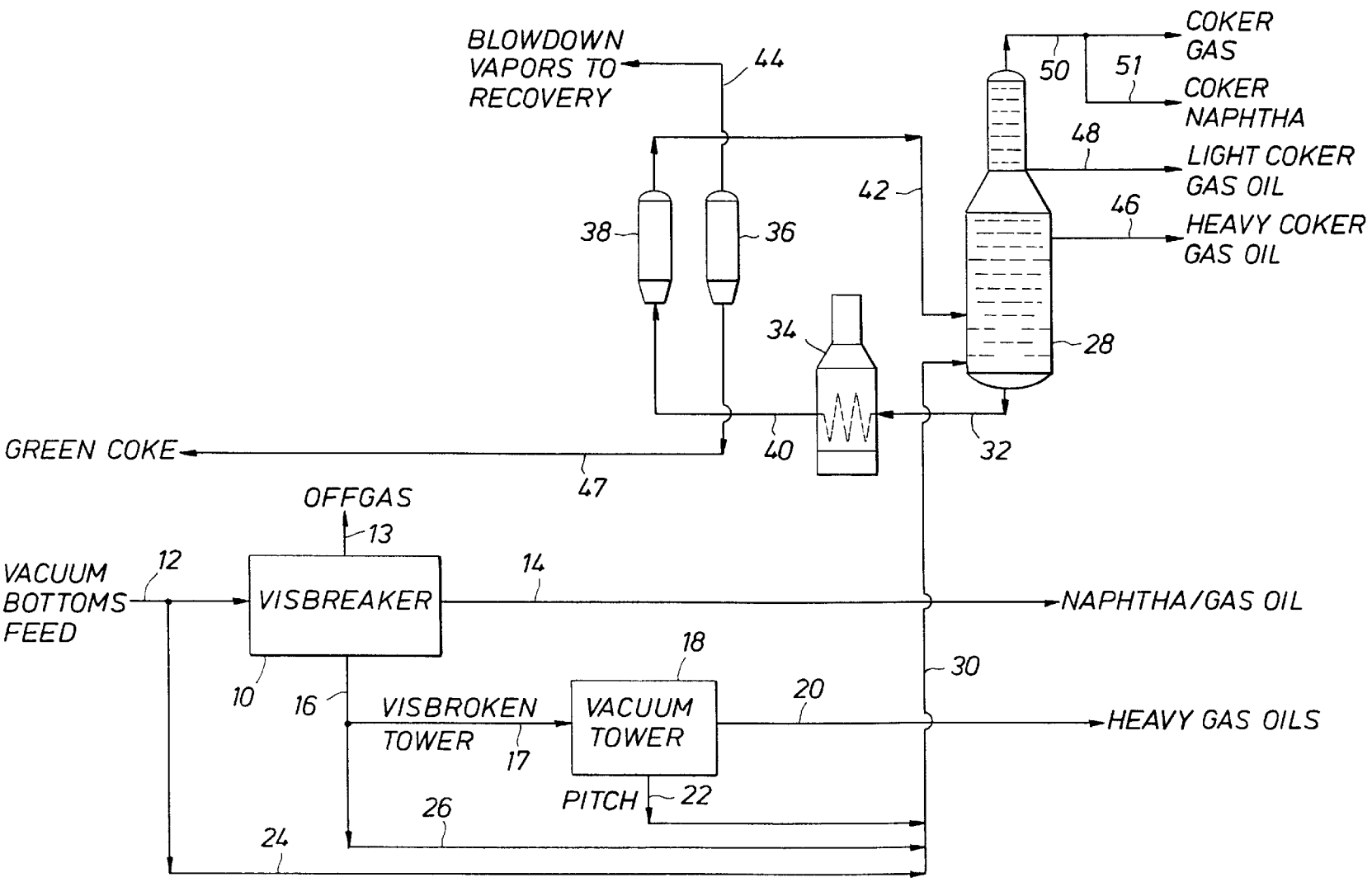
COKER GAS
COKER NAPHTHA
LIGHT COKER GAS OIL
HEAVY COKER GAS OIL
NAPHTHA/GAS OIL
HEAVY GAS OILS
51
50
48
46
28
32
30
42
34
40
44
36
38
20
18
VACUUM TOWER
22
PITCH
BLOWDOWN VAPORS TO RECOVERY
47
14
17
VISBROKEN TOWER
26
OFFGAS
13
VISBREAKER
16
10
24
12
GREEN COKE
VACUUM BOTTOMS FEED

DELAYED COKING PROCESS AND METHOD OF FORMULATING DELAYED COKING FEED CHARGE

BACKGROUND OF THE INVENTION

1. Field of the Invention

The present invention relates to a delayed coking process and, more particularly, to a delayed coking process that minimizes the production of petroleum coke derived from petroleum residua. More particularly, the present invention relates to a delayed coking process incorporating a method of preparing a delayed coker feed charge that minimizes coke make and maximizes the make of more valuable liquid products.

2. Description of the Prior Art

As the availability of lighter crude oil sources diminishes, refiners are being forced to deal with heavier crude oil feedstocks. This comes at a time when exploring for oil and gas formations is becoming increasingly more expensive and there is an increasing demand for refined products, particularly transportation fuels, such as gasoline and diesel fuel. At the same time, the markets for heavy fuel oils is diminishing. Accordingly, refiners are faced with the necessity for finding conversion processes to convert the heavy crude oil feedstocks and the various petroleum residua (residua) that occur in the normal refining processes to more useful and profitable lighter products while minimizing the production of heavy fuel oils and coke.

Existing processes for converting heavy crude feedstocks and residua to useful, lighter products include fluid catalytic cracking (FCC), residue catalytic hydrocracking (HC), and thermal cracking, such as visbreaking, delayed coking, and fluidized bed coking. Although not technically a conversion process, solvent deasphalting of residua is also becoming popular to produce feedstocks for the above-mentioned conversion processes.

The catalytic conversion processes all possess high conversion capabilities and allow for flexibility in the yield structures but are saddled with high operating costs, occasioned by expensive catalysts and/or reactions that take place at high temperatures and pressures, necessitating the use of expensive equipment. Of the thermal conversion processes noted, visbreaking has somewhat limited conversion capabilities, the conversion being limited to some extent by the end use of the resulting visbreaker tar. The visbreaker tar may also exhibit instability and incompatibility when mixed with other hydrocarbon materials. The delayed coking process is used to maximize production of liquid products while typically producing a low quality/low value coke that is used as a solid fuel. Ideally, when producing fuel grade coke in a delayed coking operation, the objective is to maximize conversion to liquid products and minimize production of fuel grade coke. While high coke yield is desirable for the production of high quality/high value needle coke and coke for anode manufacturing used in the metallurgical industries, manufacturing of fuel grade coke is to some extent considered a last resort in an attempt to extract maximum value from the crude oil.

In typical refinery processes, there are produced bottoms or residue fractions, referred to herein as "petroleum residuum" or "petroleum residua." For example, low value petroleum residuum, known as VTB, forms the bottoms fraction from a vacuum distillation tower, such towers generally being used to further fractionate virgin atmospheric-reduced crude oil. Typically, the VTB from such vacuum distillation columns generally include all the material boiling above a selected temperature, usually at least 480° C. and often as high as 590° C. Petroleum residua have typically presented serious, economic disposal problems, as it has been difficult to convert the streams to more valuable products in an economic manner. Generally speaking, petroleum residua contain components of large molecular size and weight and are generally characterized by three specific ingredients: (a) asphaltenes and other high molecular weight aromatic structures that inhibit the rate of hydrotreating/hydrocracking and cause catalyst deactivation; (b) metal contaminants that occur naturally in the crude oil or result from prior treatment of the crude oil, which contaminants deactivate hydrodesulfurization and cracking catalysts and interfere with catalyst regeneration; and (c) a relatively large content of sulfur and nitrogen compounds that give rise to objectionable quantities of $SO_2$, $SO_3$, and $NO_x$ upon combustion of the petroleum residuum. In addition, nitrogen compounds deactivate hydrotreating/hydrocracking catalysts. Thus, these residua pose economic problems if catalytic processes are used for their conversion to lighter, more valuable components.

SUMMARY OF THE INVENTION

Accordingly, it is an object of the present invention to provide a combined thermal cracking, e.g., visbreaking/delayed coking process that maximizes conversion of petroleum residua to more valuable liquid products and minimizes the production of low value coke.

Another object of the present invention is to provide a process for producing a delayed coker charge that minimizes production of low grade coke and maximizes production of more valuable liquid products.

The above and other objects of the present invention will become apparent from the drawing, the description given herein, and the appended claims.

In one embodiment, the present invention provides a process for upgrading petroleum residua to more valuable products by combining a thermal cracking operation (hereafter defined) with a delayed coking operation. According to the process, a petroleum residuum is thermally cracked, e.g., visbroken, to produce a thermally cracked bottoms stream. At least a portion of the thermally cracked bottoms stream is vacuum flashed or distilled to produce a residue thermally cracked pitch (VFP) stream. A portion of the VFP stream is blended or otherwise admixed with a hydrocarbon residuum, e.g., a petroleum residuum, that is not a VFP to produce a delayed coker feed component, the concentration of the VFP stream in the delayed coker feed component being from about 15% by weight to about 85% by weight, the blending being conducted under conditions to maintain the delayed coker feed component substantially homogeneous. A delayed coker or coker heater charge is produced that has a recycle weight ratio of less than about 1.27:1, preferably less than about 1.22:1, wherein recycle ratio is defined as the weight ratio of (a) the coker heater charge, comprising the coker feed component plus at least a portion of the heavy coker gas oil present in the product stream from the coker drums to the fractionator of the delayed coker operation, to (b) the coker feed component. The coker charge is introduced into a delayed coker to produce a product stream that includes a recycle stream containing heavy coker gas oil that is sent to a delayed coker fractionator, and a coke by-product.

In another embodiment of the present invention, there is provided an improvement in a process of delayed coking wherein a coker charge is fed to a delayed coker to produce a product stream including a recycle stream containing heavy coker gas oil that is fed to a coker fractionator, and a coke by-product, the improvement comprising thermally cracking petroleum residuum to produce a thermally cracked bottoms stream, vacuum flash distilling at least a portion of the thermally cracked bottoms stream to produce a VFP stream, blending at least a portion of the VFP stream with a hydrocarbon residuum that is not a VFP to produce a delayed coker feed component, the concentration of the VFP stream in the delayed coker feed component being from about 15% by volume to about 85% by volume, the blending being conducted under conditions to maintain the delayed coker feed component substantially homogeneous. Using the delayed coker feed component, a delayed coker feed charge is formed, the charge comprising the delayed coker feed component and at least a portion of heavy coker gas oil present in the recycle stream to the coker fractionator, the coker heater charge comprising a weight ratio of coker feed component plus said heavy coker gas oil portion of the recycle stream to the coker feed component of less than about 1.27:1, preferably less than 1.22:1.

BRIEF DESCRIPTION OF THE DRAWING

The single figure is a simplified process schematic flow diagram of the process of the present invention.

DESCRIPTION OF THE PREFERRED EMBODIMENTS

As noted above, the process of the present invention is designed to achieve maximum economic benefits from petroleum residua. At the same time, the process of the present invention possesses the capability of converting other hydrocarbon residua derived from non-petroleum sources into lighter, more valuable hydrocarbons, particularly lighter hydrocarbon liquids. As used herein in the context of the claimed process, the term "thermal cracking" does not include fluid or delayed coking but rather refers to a process in which carbon-to-carbon bonds are severed by the action of heat alone and in which cracking conditions and feedstocks are chosen so as to avoid production of any appreciable amounts of coke. Accordingly, the term "thermal cracking" includes visbreaking, a mild thermal cracking operation wherein the feed is heated to a temperature in the range of 415° C. to 495° C. and where generally only 5% to 25% of the visbreaker feed is converted to mid-distillate and lighter materials; thermal gas-oil or naphtha cracking, a more severe thermal operation operating at about 460° C. to 520° C. wherein approximately 35% or more of the feed is converted to lower molecular weight products; and steam cracking, generally conducted at temperatures in the range of 593° C. to 815° C. in which steam is used as a diluent to achieve a very low hydrocarbon partial pressure, primary products of such steam cracking generally being olefins such as ethylene, propylene, and the like. Accordingly, while the invention will be described with particular reference to visbreaking as that term is conventionally understood, those skilled in the art will appreciate that the invention is not so limited. It will also be recognized that the bottoms fractions from the thermal cracking operations contemplated by the present invention will be very heavy but will be free of any significant amounts of coke. As used herein, the term "hydrocarbon residuum" or "hydrocarbon residua" refers to a hydrocarbon material, natural or obtained as a result of processing hydrocarbon-containing materials, that is characterized by containing predominantly very high boiling components, many of which are tar-like in nature but which are composed predominantly of hydrocarbons and wherein the bulk of the material has a boiling point of greater than about 343° C. Thus, non-limiting examples of hydrocarbon residua include petroleum residuum or residua (hereinafter defined), shale oil, coal oil, and mixtures thereof As noted, petroleum residuum or residua are considered a species of the hydrocarbon residua and, as used herein, refer to a petroleum residue, typically generated in petroleum refining operations. Such petroleum residua are frequently obtained after removal of distillates from crude feedstocks and are characterized by components of large molecular size and weight, generally having (a) asphaltenes and other high molecular weight aromatic structures that inhibit the rate of hydrotreating/hydrocracking and cause catalyst deactivation; (b) metal contaminants occurring naturally in the crude or resulting from prior treatment of the crude, which contaminants deactivate hydrotreating/hydrocracking catalysts and interfere with catalyst regeneration; and (c) a relatively large content of sulfur and nitrogen compounds that give rise to objectionable quantities of $SO_2$, $SO_3$, and $NO_x$ upon combustion of the petroleum residuum. Nitrogen compounds also deactivate catalytic cracking catalysts. Non-limiting examples of petroleum residua useful in the present invention include naturally occurring crude oil, syncrude, high boiling virgin or cracked petroleum residues, such as: virgin reduced crude; bottoms from the vacuum distillation of reduced crudes (VTB); Duo-sol extract; thermal tar, sludges, and hydrocarbon waste streams. It will be apparent to those skilled in the art that other sources of hydrocarbon residua can be employed in the process of the present invention. A preferred petroleum residuum useful in the process of the present invention is a vaccumor atmospheric-reduced crude that can contain small amounts of other bottoms or residual fractions. An especially preferred petroleum residuum for use in the process of the present invention is the bottoms fraction from a vacuum distillation column. Such bottoms fractions, referred to herein as "VTB," generally include all material boiling above a selected temperature, usually at least 480° C., and often as high as 590° C.

VTB streams or similar petroleum residua are the normal feedstocks in a typical delayed coking process. Conventional thinking is that using heavier residua, e.g., visbroken bottoms, adversely affects coker heater run length due to higher carbon residue content and the coking tendency of these heavier materials. When charging these heavier visbroken materials, the negative effect on the coker heater run length can be offset to some degree by increasing significantly the recycle ratio. As used herein, "recycle ratio" is defined as the coker heater charge rate divided by the rate of fresh feed to the delayed coking process. Thus, by operating at a lower recycle ratio, lower rates of heavy coker gas oils recovered from the coking operation are included along with the coker fresh feed that is introduced into the coker heater and then into the coke drum. Accordingly, by increasing the recycle ratio, one increases the rate of heavy coker gas oils, which are included along with the fresh feed and are fed through the coker heater coils to the coking drums. The heavy coker gas oils, which, as is well known to those skilled in the art, are recovered from the coker fractionator, act as diluents to dilute the heavy, visbroken material. However, the increased recycle ratio results in reduced liquid yields and an increase in the coke yield.

In accordance with the present invention, it has been unexpectedly found that by preparing a modified and heavier residue using a portion of the bottoms stream from a thermal cracking operation as that term is used herein, which have been vacuum flash distilled, there can be obtained a coker feedstock component that permits the delayed coker process to be operated at a lower recycle ratio with a virtually unchanged heater run length. The net result is a higher liquid yield and an overall lower coke yield at nearly unchanged heater run lengths, even allowing for the positive effects of on-line spalling and state-of-the-art heater designs utilizing double-fired heater tubes. An added benefit of the present invention is a higher total yield of liquid products from the combined visbreaker (thermal cracker) and delayed coker units than from the coker unit by itself if the delayed coker were charged all of the VTB and no VTB were charged to the visbreaker. Additionally, the process reduces the demands on the coke fractionator, permitting the use of a less expensive fractionator.

The visbreaking operation used in the present invention is generally conventional and involves heating the visbreaker feed to a temperature in the range of 415° C. to 495° C., preferably 440° C. to 460° C., before passing it to a suitable soaking drum and/or a fractionator or the like. Typically, the heating coil or the soaking drum is designed to provide a sufficient reaction time to obtain a conversion of 10% or more of the feed to the visbreaker, preferably 15% to 40% conversion, where conversion is expressed as percent +343° C. feedstock disappearance. The effluent from the visbreaker is subsequently vacuum flashed or distilled to remove distillate boiling up to about 440° C. or more, preferably up to about 550° C., leaving a vacuum flashed visbroken pitch (VFP) as a bottoms fraction.

The coking process used in the present invention is a well-known delayed coking process. In the coking process, the charge stock is pumped to the coker heater at a pressure of 550 to 50 psig, where it is heated at a temperature of from about 300° C. to about 510° C. and then discharged into a vertical coking drum through an inlet at the base. Pressure in the drum is relatively low, being maintained at 10 to 80 psi, the operating temperature in the drum being between about 430° C. and 510° C. The hot charge stock cracks over a period of time in the coke drums, liberating hydrocarbon vapors, which rise through the coke mass continuously. The products containing the recycle oils or stream is sent to a coker fractionator for distillation and recovery of coker gases, gasoline, light gas oil, and heavy gas oil, the coke subsequently being removed from the drum. As seen hereafter, a portion of the heavy coker gas oil present in the recycle stream introduced into the coker fractionator is captured and combined with the fresh feed (coker feed component), thereby forming the coker heater charge.

With reference now to the figure, a petroleum residuum—in this case a VTB—enters visbreaker 10 through line 12. As is typical, visbreaker 10 operates at a temperature of from about 440° C. to about 495° C. A portion of the feed in visbreaker 10 is converted to mid-distillate and lighter materials (naphtha/gas oils), which are removed from visbreaker 10 and recovered via line 14, offgas being removed via line 13. The visbreaker bottoms are removed from visbreaker 10 via line 16 and introduced via line 17 into a vacuum tower 18, where an overhead of heavy gas oil is removed and recovered via line 20 and a VFP stream is removed as a visbreaker bottoms residue via line 22. At least a portion of the VFP stream is introduced and blended together with VTB via line 24 and visbreaker bottoms residue via line 26 into coker fractionator 28 via line 30. It will be noted that the streams in lines 22, 26, and 24, collectively referred to as fresh feed, are all hot, i.e., at a temperature greater than 260° C. so as to prevent separation of components, particularly very heavy components present in the VFP stream. If necessary, high velocity flow in the pipes and/or in-line static mixers can be used to enhance homogeneity of the fresh feed and prevent separation.

A coker heater charge is removed from coker fractionator 28 via line 32 and introduced into heater 34 and then into one of the alternating coker drums 36 and 38 via line 40. The vapor overhead product of the coking drums 36, 38 is fed to the lower section of the coker fractionator 28 via line 42, coker blowdown vapors being removed via line 44 for recovery. Green coke is removed from drums 36 and 38 via line 47.

It can be seen, in the description above, that the fresh feed is a mixture of VFP, VTB, and visbreaker bottoms residue, although it is to be understood that the invention only requires that a portion of the VFP stream in line 22 be incorporated into the fresh feed and that any other suitable hydrocarbon residuum can be admixed therewith to form the fresh feed. The hydrocarbon residuum blended or admixed with the VFP to form the fresh feed is not a VFP but can be any other suitable hydrocarbon residuum, such as VTB, visbreaker bottoms, virgin reduced crude, thermal tar, crude oil, shale oil, syncrude, coal tar oil, coal oil, and other heavy hydrocarbon residua. The VFP will be present in the fresh feed, also referred to herein as the coker feed component in an amount of from about 15% to about 85% by weight, preferably from about 25% to about 75% by weight.

The recycle ratio for a delayed coking operation is well known to those skilled in the art and can readily be seen by referring to the coking operation described in U.S. Pat. Nos. 3,116,231 and 3,960,704, incorporated herein by reference for all purposes. The recycle ratio is a volumetric or weight ratio—in this case, a weight ratio—of coker heater charge to fresh feed fed to the continuous delayed coking operation. In this instance, the fresh feed is the coker feed component passing via line 30 into coker fractionator 28, whereas the coker heater charge is the stream withdrawn from coker fractionator 28 and introduced into heater 34 via line 32, the coker heater charge, after heating, ultimately being introduced into alternate coking drums 36, 38. It will be apparent, then, that the coker heater charge is a mixture of fresh feed from line 30 and a portion of the heavy coker gas oil removed from the recycle stream in fractionator 28. Since it is desired to keep the recycle ratio at about 1.27:1 or less, preferably 1.22:1 or less, on a weight basis, for the case under consideration this would mean that, at maximum, 0.27 weight units of heavy coker oil in fractionator 28 would be mixed with one weight unit of fresh feed entering coker fractionator 28 via line 30 to produce the coker heater charge passing into coker heater 34 via line 32.

The heater 34 heats the coker feed heater charge entering via line 32 to a temperature in the range of 890° F. to 956° F. (477° C. to 510° C.), preferably 900° F. to 925° F. (482° C. to 496° C.) before passing the heated flow via line 40 to the alternately cycled coking drums 36 and 38. The coking drums 36 and 38 are designed to bring about substantial cracking and coking to yield coke and fluid products of light and heavy gas oils, naphtha, and gases.

As noted above, the vapor overhead product of the coking drums is fed to the lower section of coker fractionator 28. A heavy coker gas oil is recovered from fractionator 28 via line 46 for further processing. A light coker gas oil is removed from fractionator 28 via line 48, whereas various lower boiling point products, such as coker gases and naphtha, are recovered as an overhead fraction from fractionator 28 via lines 50 and 51, respectively.

Coker fractionator 28 is designed to separate the heavy gas oil fraction, which has a selected boiling range, e.g., 650° F. to 950° F. (343° C. to 510° C.), or to a broader range, e.g., 600° F. to 1050° F. (315° C. to 565° C.), as well as other products that can be passed on to subsequent conventional processing stages for forming diesel oil, gasoline, and other useful and more valuable end products.

As noted, the process of the present invention minimizes yield of petroleum coke from the delayed coker while maximizing overall yield of liquid products from the visbreaker and the delayed coker.

To more fully illustrate the present invention, the following non-limiting example is presented. Although the data shown in the table below is calculated data, actual refinery runs have verified the data in the table and prove that the process of the present invention, which combines a visbreaking procedure (thermal cracking) wherein a portion of the visbroken bottoms that have been vacuum flashed or distilled are used to form a coker feed component, plus delayed coking, results in a higher yield of more valuable liquid products, i.e., $C_5$+ liquids, and a lower make of coke. The data are calculated for a soaker visbreaker operating at a temperature of from 310° C. to 460° C. and a pressure of from 670 psig to 310 psig; a vacuum tower operating at a temperature of from 377° C. to 388° C. and 1.7 psia to 1.2 psia; and a delayed coker operating at a heater outlet temperature of from 471° C. to 500° C., and a coke drum pressure of from 15 psig to 30 psig. In the data shown in the table, there is shown a base case and a synergy case for various mixtures of VTB and VFP, together with the weight recycle ratios. The base case assumes that the skilled artisan would conceive of the idea of forming a coker feed component (fresh feed) containing a vacuum flashed or distilled thermally cracked pitch and, based on that assumption, uses what would be considered reasonable recycle ratios. The synergy case, on the other hand, represents the process of the present invention wherein, comparing the base case and for a given mixture of VTP and VFP, a lower recycle ratio is used. In the data shown in the table, for a given blend for both the base case and the synergy case, the heater run lengths are essentially the same. The delta values represent the increases and decreases, respectively, in the make of $C_5$+ liquids and coke by comparing the results of the base case and the synergy case. In the table below, values of $C_5$+ liquids and coke are expressed as weight percent of the vacuum bottoms feed (line 12), the delta values being the absolute differences between same. The numbers have been rounded for simplicity.

TABLE

| | Base Cases | | | Synergy Cases | | | | |
|---|---|---|---|---|---|---|---|---|
| | Recycle | | | Recycle | | | Delta | |
| Coker Feed Component | Ratio (wt) | $C_5$+ Liq. | Coke | Ratio (wt) | $C_5$+ Liq. | Coke | $C_5$+ Liq. | Coke |
| 20/80 VTB/VFP | 1.29 | 57.0 | 34.9 | 1.25 | 57.7 | 34.3 | 0.7 | −0.6 |
| 30/70 VTB/VFP | 1.27 | 57.1 | 34.9 | 1.22 | 58.0 | 34.2 | 0.9 | −0.7 |
| 40/60 VTB/VFP | 1.24 | 57.1 | 34.9 | 1.19 | 58.2 | 34.0 | 1.1 | −0.9 |
| 50/50 VTB/VFP | 1.22 | 57.1 | 34.9 | 1.16 | 58.3 | 34.0 | 1.2 | −0.9 |
| 60/40 VTB/VFP | 1.20 | 57.1 | 34.9 | 1.14 | 58.3 | 34.0 | 1.2 | −1.0 |
| 70/30 VTB/VFP | 1.17 | 57.1 | 34.9 | 1.12 | 58.2 | 34.0 | 1.1 | −0.9 |

TABLE-continued

| | Base Cases | | | Synergy Cases | | | | |
|---|---|---|---|---|---|---|---|---|
| | Recycle | | | Recycle | | | Delta | |
| Coker Feed Component | Ratio (wt) | $C_5$+ Liq. | Coke | Ratio (wt) | $C_5$+ Liq. | Coke | $C_5$+ Liq. | Coke |
| 80/20 VTB/VFP | 1.15 | 57.2 | 34.9 | 1.11 | 58.0 | 34.2 | 0.8 | −0.7 |

It can be seen from the data in the table above that by using the process of the present invention wherein there is inclusion of the VFP in what ultimately forms the coker heater charge, one can obtain acceptable, and indeed substantially the same, heater run lengths at a lower recycle ratio than what can be obtained using conventional, prior art thinking, which would dictate a higher recycle ratio if, which the prior art does not contemplate, a visbroken pitch were present as a component of the fresh feed. Furthermore, as the data show, for a substantially equal heater run length, i.e., comparing the base case to the synergy case, the synergy case, i.e., the process of the present invention, results in an increase in the total $C_5$+ liquid make, taking into account $C_5$+ liquid recovered both from the visbreaking operation, e.g., from line 14, and the delayed coking, e.g., from line 51, and a decrease in the coke make. Lastly, the data in the table show that whereas the process of the present invention is generally operable with a VFP content in the coker feed component ranging from about 15% to about 85% by weight, particularly desirable results are obtained when the VFP component ranges from about 25% to about 75% by weight. As noted, actual refinery runs have verified the data shown above in the table in that when the process of the present invention is practiced, there is lower coke make and a higher make of more valuable liquids.

The foregoing description and examples illustrate selected embodiments of the present invention. In light thereof, variations and modifications will be suggested to one skilled in the art, all of which are in the spirit and purview of this invention.

What is claimed is:

1. A process for upgrading hydrocarbon residua to more valuable products, comprising:

thermally cracking a petroleum residuum selected from the group consisting of atmospheric-reduced crudes, virgin-reduced crudes, vacuum tower bottoms, and mixtures thereof to produce a thermally cracked bottoms stream;

vacuum distilling at least a portion of said thermally cracked bottoms stream to produce a vacuum distilled thermally cracked pitch (VFP) stream;

blending at least a portion of said VFP stream with at least one of said petroleum residua to produce a delayed coker feed component, the concentration of said VFP stream in said delayed coker feed component being from about 15% by weight to about 85% by weight, said blending being conducted under conditions to maintain said delayed coker feed component substantially homogeneous;

producing a delayed coker heater charge having a recycle weight ratio of less than about 1.27:1; and introducing said coker heater charge into a delayed coker.

2. The process of claim 1 wherein said petroleum residuum comprises a vacuum towers bottoms stream.

3. The process of claim 1 wherein the concentration of said VFP stream in said delayed coker feed component is from about 25% by weight to about 75% by weight.

4. The process of claim 1 wherein said recycle ratio is less than about 1.22:1.

5. The process of claim 1 wherein said thermally cracked bottoms stream is a visbreaker bottoms stream.

6. In a process of delayed coking wherein a coker charge is fed to a delayed coker to produce coke and a recycle stream containing heavy coker gas oil that is fed to a coker fractionator, the improvement comprising:

thermally cracking a petroleum residuum selected from the group consisting of atmospheric-reduced crudes, virgin-reduced crudes, vacuum tower bottoms, and mixtures thereof to produce a thermally cracked bottoms stream;

vacuum distilling at least a portion of said thermally cracked bottoms stream to produce to a vacuum distilled thermally cracked pitch (VFP) stream;

blending at least a portion of said VFP stream with at least one of said petroleum residua to produce a delayed coker feed component, the concentration of said VFP stream in said delayed coker feed component being from about 15% by volume to about 85% by weight, said blending being conducted under conditions to maintain said delayed coker feed component substantially homogeneous;

forming a delayed coker heater charge comprising said delayed coker feed component and at least a portion of the heavy coker gas oil in said recycle stream, said coker charge comprising a weight ratio of coker feed component plus said portion of said heavy coker gas oil to said coker feed component of less than about 1.27:1.

7. The process of claim 6 wherein said petroleum residuum comprises a vacuum towers bottoms stream.

8. The process of claim 6 wherein the concentration of said VFP stream in said delayed coker feed component is from about 25% by weight to about 75% by weight.

9. The process of claim 6 wherein said recycle ratio is less than about 1.22:1.

10. The process of claim 6 wherein said thermally cracked bottoms stream is a visbreaker bottoms stream.

* * * * *